US005694856A

United States Patent [19]

Theurer

[11] Patent Number: 5,694,856

[45] Date of Patent: Dec. 9, 1997

[54] RAIL ANCHOR APPLICATION MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 715,024

[22] Filed: Sep. 17, 1996

[30] Foreign Application Priority Data

Oct. 13, 1995 [AT] Austria ..... 1697/95

[51] Int. Cl.[6] ..... E01B 29/32

[52] U.S. Cl. ..... 104/17.2

[58] Field of Search ..... 104/2, 17.2

[56] References Cited

U.S. PATENT DOCUMENTS 3,117,531 1/1964 Miller ..... 104/17.2
4,903,611 2/1990 Holley ..... 104/17.2
5,117,760 6/1992 Almaraz et al. ..... 104/17.2
5,142,987 9/1992 Freymuth et al. ..... 104/17.2
5,227,122 7/1993 Almaraz et al. ..... 104/17.2

*Primary Examiner*—S. Joseph Morano
*Attorney, Agent, or Firm*—Henry M. Feiereisen

[57] ABSTRACT

A rail anchor application machine for squeezing an anchor to a tie-mounted rail of a track, includes a machine frame supported on undercarriages for traveling in an operating direction on the track and an anchor adjustment device which is vertically adjustable relative to the machine frame by a first drive. The anchor adjustment device is provided on both longitudinal sides of the rail with a pair of squeezing tools which pivot relative to one another in longitudinal direction of the rail by a second drive about a first horizontal axis that extends in a direction transversely to the machine frame. In addition, the anchor adjustment device is equipped with a third drive to pivot the squeezing tools in a direction transversely to the track about a second axis which extends perpendicular to the first axis.

16 Claims, 3 Drawing Sheets

11
32
23
22
28
29
45
4
25
26
14
13
20
19
34
35
24
30
31
28
5
6
33
21
2

6
4
22
33
23
24
30
28
25
37
27
20
13
34
14
38
36
34
18
35
2
19
26
22
46
28
29
11
5

Fig. 5
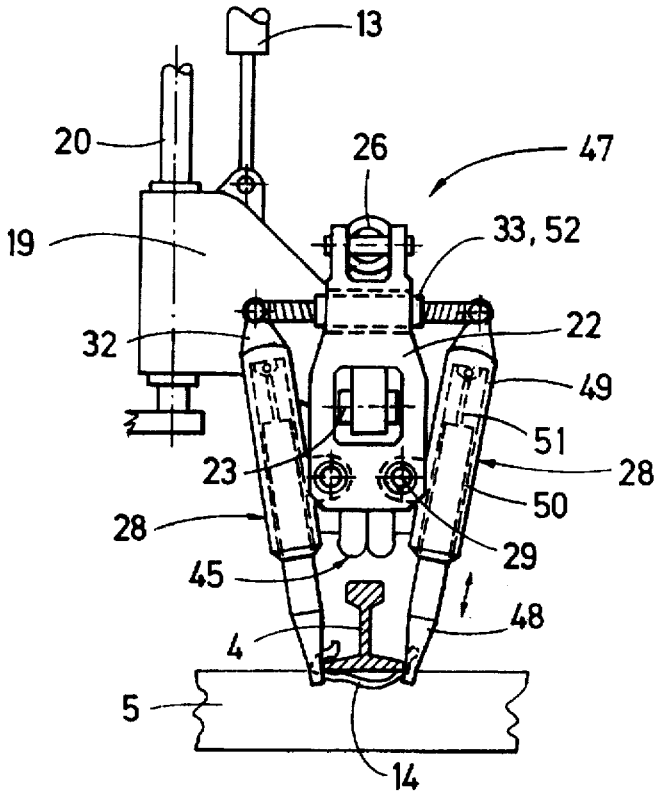
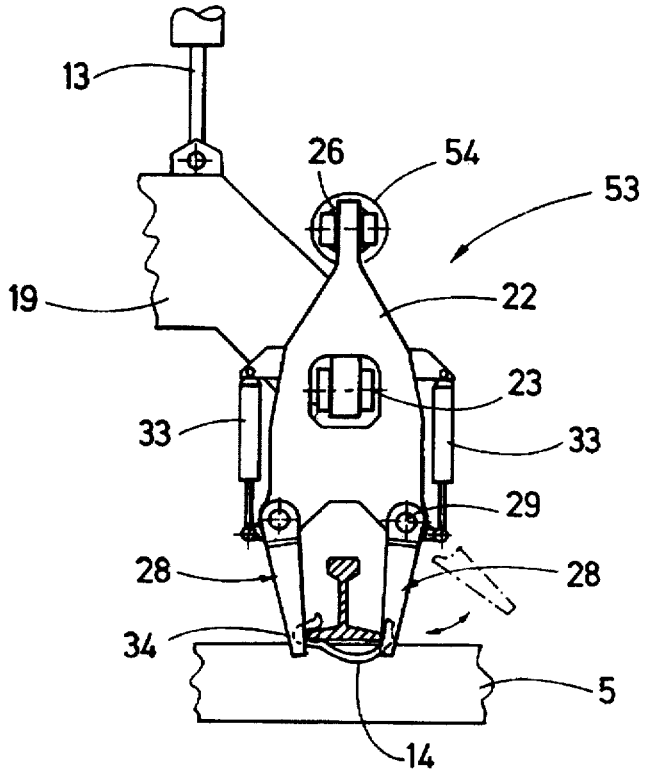
Fig. 6

RAIL ANCHOR APPLICATION MACHINE

BACKGROUND OF THE INVENTION

The present invention refers to a machine for applying an anchor to a tie-mounted rail of a track.

Rail anchors are installed on the rail base and directly bear on one or both vertical longitudinal faces of the tie so as to prevent or resist longitudinal rail movement (rail creepage), resulting from forces of traffic and changing temperatures. The rail anchors thus enable to maintain a correct track geometry.

Rail anchor application machines typically include a machine frame, which is supported on undercarriages for traveling on a track, and an anchor adjustment unit which is vertically adjustable by a drive and is provided on both longitudinal sides of the rail with a pair of squeezing tools for engagement with respectively positioned rail anchors. The squeezing tools are swingably supported relative to each other in longitudinal direction of the rail for rotation about a horizontal axis extending in a direction transversely to the machine frame.

U.S. Pat. No. 5,277,122, issued on Jan. 11, 1994, discloses a machine which is provided with an anchor adjustment unit for each rail of the track for exerting a squeezing action to effect sufficient anchor contact with the tie, with each anchor adjustment unit being supported by means of a vertical guidance on the machine frame. The anchor adjustment units are interconnected by a hydraulic cylinder, and each includes four squeezing tools which are positioned on both longitudinal sides of the rail, with pairs of squeezing tools being movable relative to each other in longitudinal direction of the track. The upper ends of the pairs of squeezing tools are connected to each other by a hydraulic drive for swinging the squeezing tools about a horizontal axis which parallels the longitudinal direction of the ties. The squeezing tools are of plate-shaped configuration and exhibit a lower end in the form of a replaceable anchor-engaging adjuster member. In order to accommodate variations in the width of the rail and thus to regulate the distance of opposing squeezing members in transverse direction of the track on both sides of the rail, a system of interchangeable, washer-type spacer plates of different widths is used which can be optionally installed to prevent damage of the rail base when the tools are lowered into engagement with a rail, and to avoid a misplacement of the rail anchor as a result of an excessive rail distance in transverse direction.

U.S. Pat. No. 5,142,987, issued on Sep. 1, 1992, discloses a machine that combines the installation of rail anchors for a rail with an adjustment of the anchor at the side faces of the ties. Positioned in the area of each longitudinal side of the tie is a device for supplying and placement of a rail anchor on the base of the rail with firm hydraulic pressure. Before the clamp-type anchor snaps into place, both anchor applicators are moved by a hydraulic drive in longitudinal direction of the rail toward each other, with the anchors being firmly squeezed from both sides onto the tie through transfer plates and subsequently fixed in place in this position with the rail.

SUMMARY OF THE INVENTION

It is an object of the present invention to provide an improved rail anchor application machine which accomplishes a reliable squeezing and adjustment of rail anchors even in cases in which the squeezing tools are not precisely centered with respect to the rail, and in cases of varying rail configurations and varying widths of rail bases, without necessitating any retrofitting of the machine.

This object, and others which will become apparent hereinafter, is attained in accordance with the present invention by swinging the squeezing tools of the anchor adjustment units relative to each other in longitudinal direction of the rail about a first horizontal axis which extends in a direction transversely to the machine frame, and by additionally swinging the squeezing tools in a direction transversely to the track about a second axis which extends perpendicular to the horizontal axis.

This enables in a simple and reliable manner to expand the effective range of the squeezing tools in such a manner as to compensate for various disruptive factors such as e.g. inaccurate centered position of the squeezing tools, and/or varying widths of rail bases, or different types of anchors. The squeezing tools which in idle position are in spread-apart relationship in longitudinal direction of the ties automatically afford a relative wide range of use for insuring immediately before execution of the squeezing action upon the rail anchors a precise centering of the squeezing tools in longitudinal direction of the ties, because the engagement of the squeezing tools at the rail base edges effects an automatic centering of the squeezing tools before engagement with the anchors in longitudinal direction of the rails. Thus, by using the rail base edges as guidance, the drawback of conventional machines that position the squeezing tools from the rail base at a slight safety distance, which is detrimental to a secure contact of the already very small anchors with the ties, is eliminated. Moreover, as the squeezing tools prevent the afore-stated disruptive factors from adversely affecting the operation, the overall monitoring of the machine by the operator is considerably facilitated because there is no need to check for these disruptive factors, and ensuing retrofitting of the machine thus becomes unnecessary.

According to another feature of the present invention, each anchor adjustment unit includes two swivel frames which are spaced from each other in longitudinal direction of the machine frame for support of two squeezing tools that oppose each other relative to the rail in a direction transversely to the track. The squeezing tools are preferably formed as vertical arms which exhibit upper ends connected to each other by a drive, with the second axis being positioned approximately in midsection of the arms.

Suitably, each swivel frame and each squeezing tool is associated to a separate centering unit for automatic stabilization of the swivel frame and the squeezing tool relative to the vertical. Each centering unit may include elastically deformable attenuation elements, with the attenuation elements for the squeezing tool being positioned immediately underneath the second axis and abutting each other back-to-back in direction transversely to the machine frame.

According to a modification of the anchor adjustment units of the present invention, the squeezing tools are each comprised of a lower part and an upper part, with the lower part engaging the anchor and being movable relative to the upper part in a substantial vertical direction, whereby the upper part is swingably mounted about the second axis and forms a guidance for the lower part.

According to another feature of the present invention, two anchor adjustment units are provided for each rail of the track and mounted on the machine frame at a distance to each other in longitudinal direction of the machine frame, with one of the anchor adjustment units being moveable longitudinally in direction of the track relative to the other anchor adjustment unit. In this manner, the operating speed and thus the productivity of the rail anchor application machine can be doubled in a simple manner.

Suitably, the rail anchor application machine further includes a vertically adjustable sweeping device which is secured to the machine frame on both longitudinal rail sides in the areas of the anchors, with the sweeping device including flexible sweeping elements and a rotating drive for rotating the sweeping elements about a vertical axis of rotation.

BRIEF DESCRIPTION OF THE DRAWING

The above and other objects, features and advantages of the present invention will now be described in more detail with reference to the accompanying drawing in which:

FIG. 5 is a side view of a modified anchor adjustment unit according to the present invention in longitudinal direction of the track; and FIG. 6 is a side view of a further variation of an anchor adjustment unit according to the present invention in longitudinal direction of the track.

DETAILED DESCRIPTION OF PREFERRED EMBODIMENTS

Figures 1, 2:
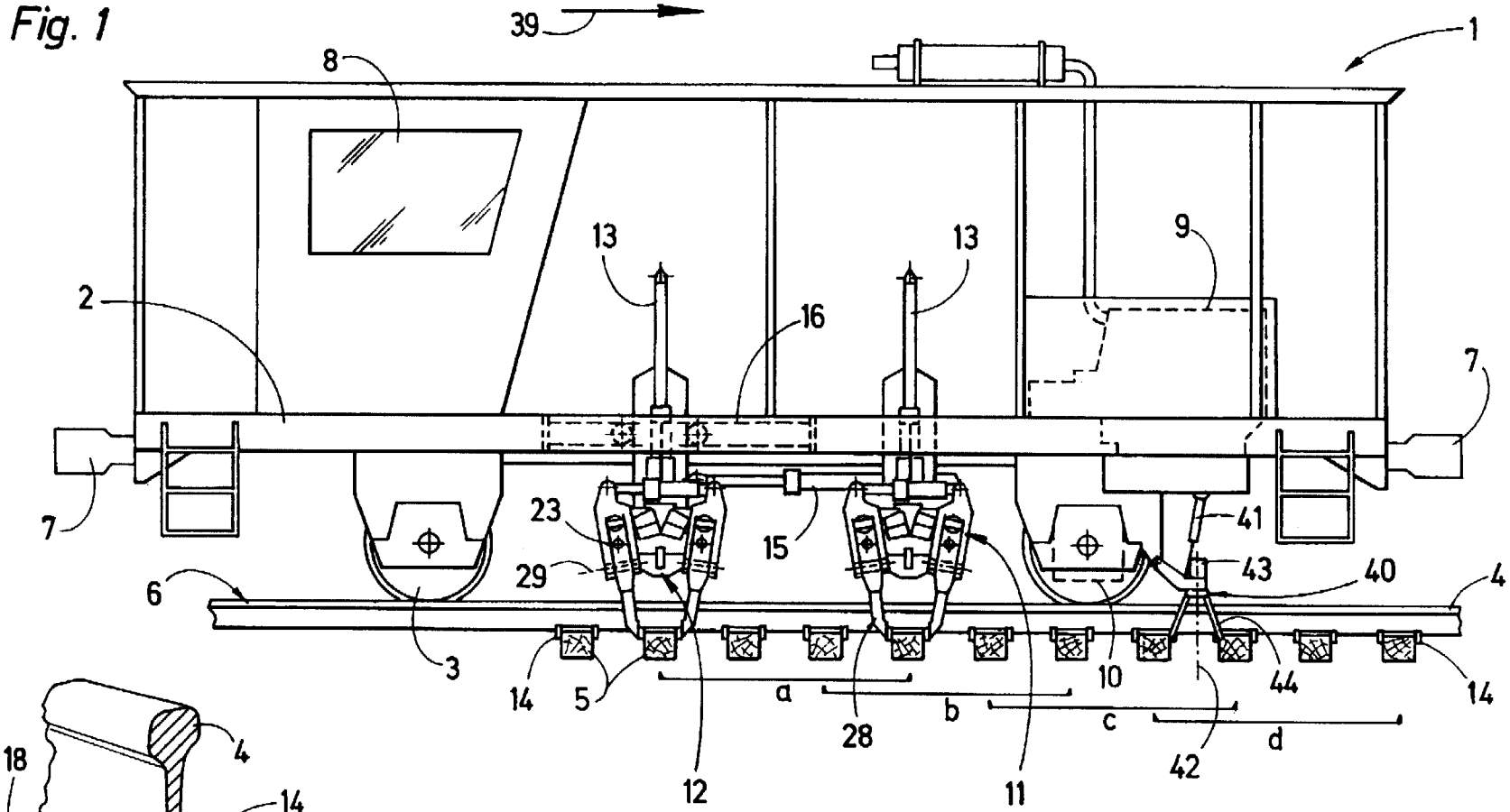
Fig. 2 (Prior Art)
FIG. 1 is a side-elevational view of one embodiment of a rail anchor application machine according to the present invention.
FIG. 2 is a perspective illustration of an exemplified rail anchor mounted to a rail base.

Throughout all the Figures, the same or corresponding elements are generally indicated by the same reference numerals.

Turning now to the drawing, and in particular to FIG. 1, there is shown a side elevational view of one embodiment of a rail anchor application machine according to the present invention, generally designated by reference numeral 1. The rail anchor application machine 1 includes a machine frame 2 which is supported on undercarriages 3 for traveling along a track 6 comprised of rails 4 fastened to ties 5 in an operating direction, indicated by arrow 39. The machine frame 2 is provided on both axial ends with a coupling 7 and is propelled by a drive 10 which acts upon the leading undercarriage 3. A power plant 9 is mounted at a front end of the machine frame 2 to supply power to all the drives of the machine 1. At its trailing end, the machine frame 2 carries an operator's cab 8.

Figure 4:
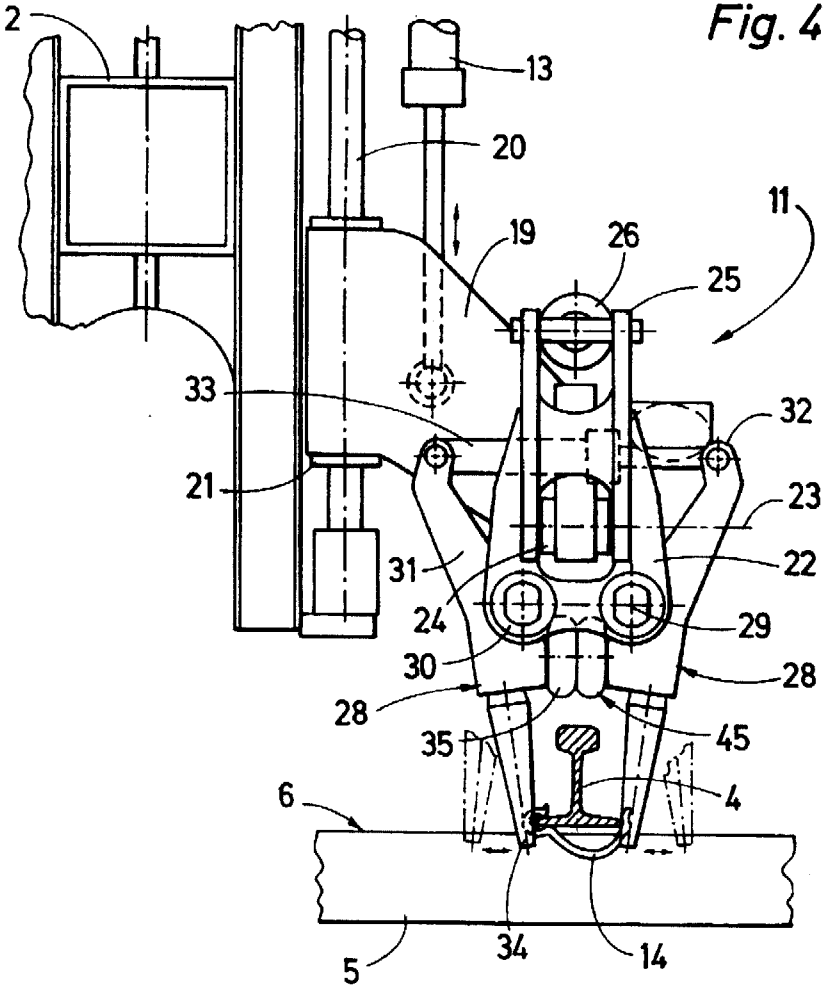
FIG. 4 is an enlarged side view of the anchor adjustment unit of FIG. 3 in longitudinal direction of the track.

In the area between both undercarriages 3, the machine frame 2 supports two anchor adjustment units 11, 12 which are spaced from each other longitudinally in direction of the machine frame and associated to one rail 4 of the track 6, as shown in FIG. 4. Although not shown in the drawing, the rail anchor application machine 1 is provided with two more anchor adjustment units which are positioned above the other rail 4 of the track 6 and disposed relative to the anchor adjustment units 11, 12 symmetrically in relation to a vertical longitudinal plane of symmetry of the machine 1. The adjustment units are individually vertically adjustable by drives 13 and exert the required squeezing action to effect a sufficient anchor contact of the anchors 14 on the ties 5. A drive 15 moves the adjustment unit 12 longitudinally in direction of the track relative to the adjustment unit 11, whereby the anchor adjustment unit 12 is slidably supported in a manner known per se upon a longitudinal guide 16 of the machine frame 2.

FIG. 2 shows a typical rail anchor 14 in form of a metallic clamp 17 which is secured to the rail base 18 and snaps under prestress. A displacement along the rail 4 is possible upon application of a suitable force.

Figure 3:
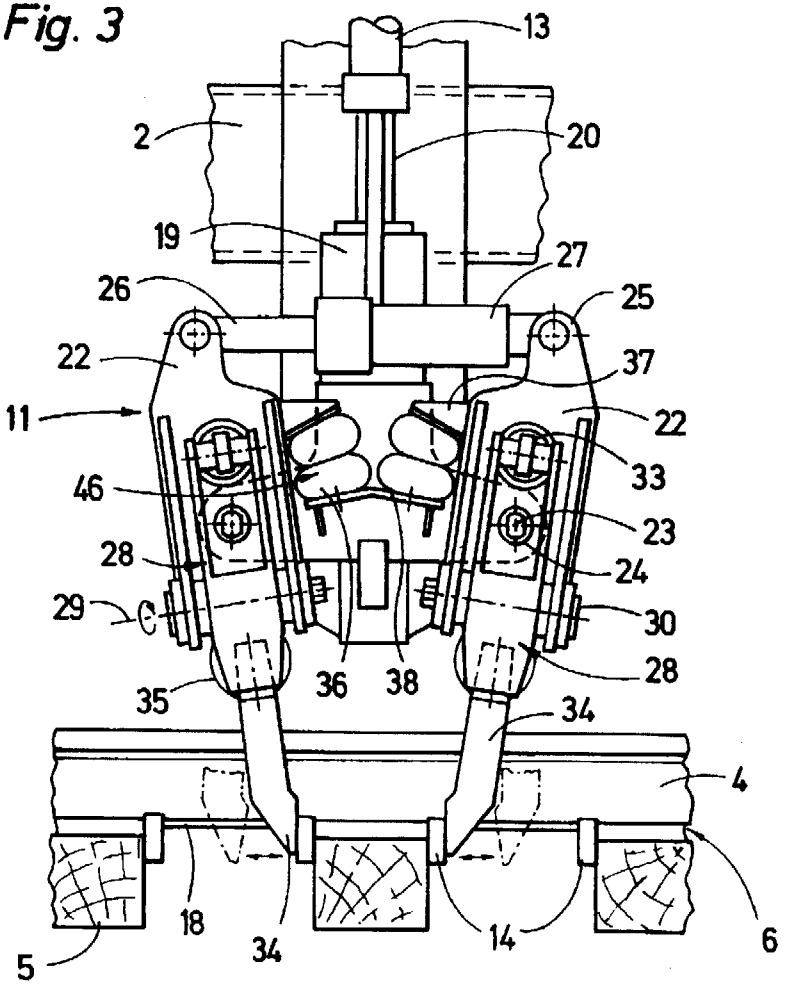
FIG. 3 is an enlarged side view of the rail anchor application machine of FIG. 1 in a direction transversely to the track, illustrating in detail an anchor adjustment unit of the machine.

Turning now to FIGS. 3 and 4, there are shown enlarged side views of the anchor adjustment unit 11 in transverse direction and longitudinal direction. It will be appreciated by persons skilled in the art that all anchor adjustment units are of identical structure and that the description of the anchor adjustment device 11 is done by way of example only.

The anchor adjustment unit 11 is secured to a carrier frame 19 which is formed on one end with a sliding bush 21 for movement along a vertical guide rod 20 by means of the drive 13 which is suitably linked to the carrier frame 19, whereby the guide rod 20 is connected to the machine frame 2. The anchor adjustment unit 11 includes two swivel frames 22 which are supported by the carrier frame 19 and spaced from each other longitudinally in direction of the machine frame 2. Each swivel frame 22 is mounted on an axle 24 so as to be swingable relative to the carrier frame 19 about a horizontal axis 23 which extends across the machine frame 2. The upper ends 25 of both swivel frames 22 are joined together by a drive 26 in the form of a hydraulic cylinder 27.

Supported on each swivel frame 22 is a pair of squeezing tools 28 which oppose each other across the rail 4 in a direction transverse to the machine frame 2 and are each mounted on a separate axle 30 for swinging in a direction transversely to the machine frame 2 about a second axis 29 which is oriented perpendicular to the axis 23. The squeezing tools 28 of a common swivel frame 22 are respectively associated to one longitudinal side of the rail, with the axles 30 extending in parallel relationship to each other and spaced apart in transverse direction of the machine frame 2. Both squeezing tools 28 are shaped in the form of substantially vertical arms 31 with their upper ends 32 being interconnected by a drive 33 which is housed in an opening of the swivel frame 22 whereby the axle 30 and thus the second axis 29 extends approximately in midsection of each arm 31. The lower section of the squeezing tools 28 is formed as detachable anchor-engaging adjuster member 34.

As shown in FIG. 4, a centering unit, generally designated by reference numeral 45 is arranged between the two squeezing tools 28 of each swivel frame that oppose each other across the track 6 and includes elastically deformable attenuation elements 35 which can be made e.g. of rubber. The attenuation elements 35 are secured to each squeezing tool 28 immediately underneath the second axis 29 and abut each other back-to-back in direction transversely to the machine frame 2. Upon activation of the drive 33 to pivot of the anchor-engaging adjuster members 34 about the axis 29, the attenuation elements 35 are compressed and the squeezing tools 28 are precisely centered with regard to the rail 4 by bearing upon the rail base edges.

As shown in FIG. 3, a further centering unit, generally designated by reference numeral 46 is disposed between the squeezing tools 28 of the two swivel frames 22 in opposite relationship to each other in longitudinal direction of the track 6, and includes attenuation elements 36 which are positioned between a bracket 37 of each of the swivel frames 22 and a mounting 38 which is attached to the carrier frame 19. When activating the drive 26 to respectively spread apart the squeezing tools 28 in longitudinal direction of the track about the axis 23, the attenuation elements 36 are compressed so as to effect a precise centered position of the anchor-engaging adjuster members 34.

At the start of the operation of the anchor adjustment units 11, 12, the four squeezing tools 28 of each anchor adjustment unit are spread apart in longitudinal direction of the track 6 by the drive 26, as indicated in dashdot line in FIG. 3, and in a direction transversely to the track 6 by the drive 33, as indicated in dashdot line in FIG. 4. Each squeezing tool 28 is thus being pivoted about the axis 23 and the axis 29 which extend perpendicular to one another. The attenuation elements 36 of the centering unit 46 insure that the swinging motion of the swivel frames 22 through activation of the drive 26 is executed in symmetry to one another, i.e. in symmetry to the vertical so that a stabilization of both swivel frames 22 of each anchor adjustment unit 11, 12 is automatically accomplished. Subsequently, the anchor adjustment unit 11, 12 positioned above a crossing point of rail 4 and tie 5 is lowered by the drive 13 until the anchor-engaging adjuster member 34 slightly projects downwards beyond the rail base 18.

Both drives 33 are now activated and the anchor-engaging adjuster members 34 bear on both sides upon the rail base 18, with the attenuation elements 35 of the centering unit 45 ensuring a centered alignment of the adjuster members 34 relative to the rail 4 and automatically stabilizing the squeezing tools 28 in relation to the vertical. The drive 26 is then again activated to move the opposing anchor-engaging adjuster members 34 toward one another in the longitudinal direction. The rail base 18 serves thereby as a guiding rail for directing the advancing adjuster members 34 towards the rail anchor 14. Thus, the rail anchors 14 are reliably grasped and squeezed against the vertical side faces of the ties 5.

It will be appreciated by persons skilled in the art that it is not necessarily required to lift the entire anchor adjustment units 11, 12 after each cycle to a position above the rail 4; Rather, in most cases it will be sufficient to activate the drive 13 to such an extent that the spread-apart adjuster members 34 are positioned slightly over the top face of the ties 5.

The relative positioning of both anchor adjustment units 11, 12 to one another as effected by the drive 15 depends, on the one hand, on the average spacing between the ties 5 in the track 6 and, on the other hand, on whether each individual or only every second tie 5 is to be secured with rail anchors 14. In the latter case, the anchor adjustment units 11,12 are spaced from one another at twice the tie spacing, and the rail anchor application machine 1 is advanced by four tie spacings. FIG. 1 shows the other situation in which rail anchors 14 are applied on each tie 5 of the track 6. Suitably, the distance between both anchor adjustment units 11,12 corresponds in longitudinal direction of the machine frame 2 to three tie spacings, with the rail anchor application machine 1 being advanced after each adjustment by two ties in direction of arrow 33, as indicated by brackets designated a, b, c, d in FIG. 1.

In order to free the area of the rail anchors 14 on both sides of the rail base 18 from ballast and gravel and thus to ensure an unproblematic engagement of the adjuster members 34 even in the event of ballast accumulations, the rail anchor application machine 1 is equipped with a sweeping device 40, as illustrated in FIG. 1. The sweeping device 40 is disposed in operating direction ahead of the anchor adjustment units 11, 12 and is secured to the machine frame 2. The sweeping device 40 can be lowered at both longitudinal sides of the rail by means of a drive 41 and includes flexible sweeping elements 44 which are rotatable about a vertical axis of rotation 42 by means of a rotating drive 43. The sweeping elements 44 are arranged at an angle to the axis of rotation 42 such as to describe an acute cone during rotational motion.

Turning now to FIG. 5, there is shown a side view of a modified anchor adjustment unit, generally designated by reference numeral 47 and shown in longitudinal direction of the track, which differs from the anchor adjustment units 11, 12 as shown in FIGS. 3 and 4 in the configuration of the squeezing tools 28. As shown in FIG. 5, the squeezing tools 28 are of two-part configuration with a lower part 48 and an upper part 49, whereby the lower part 48 engages the rail anchor 14 and is adjustable relative to the upper part 49, and whereby the upper part 49 is swingably supported to the carrier frame 19 for rotation about the axis 29 and shaped as a cylindrical tube to form a guide 50 in which the lower part 48 of the squeezing tool 28 is slidable in a substantially vertical direction. The displacement of the lower part 48 of the squeezing tool 28 is effected by a hydraulic drive 51 which is integrated in the lower part 48.

In the embodiment of the anchor adjustment unit 47, the drive 33 is provided in the form of a spindle drive 52 by which the upper ends 32 of the squeezing tools 28 that oppose each other across the track 6 are interconnected to one another.

During advance from job site to job site of the rail anchor application machine 1 provided with an anchor adjustment unit 47, there is no need to raise the anchor adjustment unit 47 by the drive 13; Rather it is sufficient to slightly spread apart the squeezing tools 28 transversely in direction of the track by means of the spindle drive 52 and slightly vertically adjust the lower pads 48 of the squeezing tools 28 by means of the drives 51.

FIG. 6 shows a side view of still another variation of an anchor adjustment unit, generally designated by reference numeral 53, and having squeezing tools 28 which are each equipped with a separate drive 33. The drives 33 are respectively linked to the swivel frame 22 and ensure a relative wide lateral displacement of the respective squeezing tool 28 in direction transversely to the track and a swinging thereof about the second axis 29 in order to move the anchor-engaging adjuster member 34 into the area above the ties 5. Thus, the anchor adjustment unit 53 can continuously remain in lowered operative position. The drive 26 is suitably equipped with a vibrator 54 for oscillating the swivel frame 22 and thereby facilitate a penetration of the anchor-engaging adjuster members 34 through possibly accumulating ballast between the ties 4 and ensure an unproblematic displacement even at jammed rail anchors.

While the invention has been illustrated and described as embodied in a rail anchor application machine, it is not intended to be limited to the details shown since various modifications and structural changes may be made without departing in any way from the spirit of the present invention.

What is claimed as new and desired to be protected by Letters Patent is set forth in the appended claims:

1. A machine for applying a rail anchor to a tie-mounted rail of a track, comprising:

a machine frame supported on undercarriages for traveling in an operating direction along the track; and an anchor adjustment device for exerting a squeezing action to effect an anchor contact with a tie, said anchor adjustment device including pairs of squeezing tools respectively positioned on both longitudinal sides of the rail, a first drive for vertically adjusting the anchor adjustment device, a second drive for swinging the squeezing tools relative to each other in longitudinal direction of the rail about a first horizontal axis extending in a direction transversely to the machine frame, and a third drive for swinging the squeezing tools in a direction transversely to the track about a second axis extending perpendicular to the first axis.

2. The machine of claim 1, and further comprising a carrier frame secured to the machine frame, said squeezing tools being mounted on an axle secured to a swivel frame and defining the second axis, with the swivel frame being swingably mounted on an axle which is supported by the carrier frame and defines the first axis.

3. The machine of claim 2 wherein the anchor adjustment device includes two said swivel frames spaced from each other in longitudinal direction of the machine frame, each said swivel frame supporting two squeezing tools in opposite relationship to each other with regard to the rail in a direction transversely to the track.

4. The machine of claim 3 wherein both said swivel frames exhibit upper ends connected to each other by the second drive for swinging the swivel frames relative to one another, with the second drive extending longitudinally in parallel relationship to the track.

5. The machine of claim 3 wherein each said squeezing tool is configured in the form of a substantially vertical arm, with the two squeezing tools of a common swivel frame exhibiting upper ends which are connected to one another by the third drive, with the second axis being positioned approximately in a midsection of the arm.

6. The machine of claim 3 wherein the anchor adjustment device includes first and second centering units, with the first centering unit being associated to the swivel frames for automatic stabilization of the swivel frames relative to a vertical line, and with the second centering unit being associated to the squeezing tools for automatic stabilization of the squeezing tool relative to a vertical line.

7. The machine of claim 6 wherein each of the centering units includes elastically deformable attenuation elements.

8. The machine of claim 7 wherein the attenuation elements of the second centering unit are positioned immediately underneath the second axis and abutting each other in back-to-back relationship in a direction transversely to the machine frame.

9. The machine of claim 3 wherein at least one of the swivel frames includes a vibrator for generating oscillations.

10. The machine of claim 1 wherein each of the squeezing tools exhibits a lower section formed with a detachable anchor-engaging adjuster member.

11. The machine of claim 1 wherein each of the squeezing tools is comprised of a lower part and an upper part, with the lower part engaging the anchor and being adjustable with regard to the upper part, and with the upper part being swingably mounted about the second axis.

12. The machine of claim 11 wherein the anchor adjustment device includes a fourth drive, said upper part forming a guidance during displacement of the lower part relative to the upper part in a substantial vertical direction by means of the fourth drive.

13. The machine of claim 1 wherein two such anchor adjustment devices are provided for each rail of the track and mounted on the machine frame at a distance to each other in longitudinal direction of the machine frame.

14. The machine of claim 13, and further comprising a fifth drive for moving one of the anchor adjustment devices in the longitudinal direction of the track relative to the other anchor adjustment device.

15. The machine of claim 1, and further comprising a sweeping unit secured to the machine frame on both longitudinal rail sides in an area of the anchors, and a sixth drive for vertically adjusting the sweeping unit.

16. The machine of claim 15 wherein the sweeping unit includes flexible sweeping elements and a rotating drive for rotating the sweeping elements about a vertical axis of rotation, with the sweeping elements being at an angled disposition relative to the axis of rotation so as to describe an acute cone during rotational motion.

* * * * *